United States Patent [19]

Redwine

[11] 4,221,370

[45] Sep. 9, 1980

[54] OBSTETRIC CHAIR

[75] Inventor: Michael A. Redwine, Aurora, Nebr.

[73] Assignee: Century Mfg. Co., Aurora, Nebr.

[21] Appl. No.: 888,321

[22] Filed: Mar. 20, 1978

[51] Int. Cl.[3] ..... A61G 13/00

[52] U.S. Cl. ..... 269/323; 269/328

[58] Field of Search ..... 269/322–328; 297/68, 88, 346

[56] References Cited

U.S. PATENT DOCUMENTS

| | | | |
|---|---|---|---|
| 799,702 | 9/1905 | Barlow | 269/326 |
| 2,073,094 | 3/1937 | Bugh | 269/327 |
| 3,318,596 | 5/1967 | Herzog | 269/324 |
| 3,486,747 | 12/1969 | Cardoso | 269/325 |
| 3,532,336 | 10/1970 | Baker | 269/328 |
| 4,136,858 | 1/1979 | Petersen | 269/328 |
| 4,139,917 | 2/1979 | Fenwick | 269/325 |
| 4,180,062 | 12/1979 | Alberti et al. | 269/328 X |

*Primary Examiner*—Robert C. Watson

*Attorney, Agent, or Firm*—Vincent L. Carney

[57] ABSTRACT

To support a patient in an obstetric chair positioned for the convenience of the physician, the patient-receiving portion of the chair is mounted for changes in elevation and for different attitudes and includes channel-like thigh supports which confine the thighs of the patient and a recessed seat portion for supporting the buttocks of the patient. The backrest is vertical to the seat portion and has a central section extending slightly forward with two recessed portions and an overhanging back portion to further confine the patient between curved side portions. The channel-like thigh supports may be adjusted in angle with respect to each other and the seat portion is cut away to permit access to the perineum.

7 Claims, 4 Drawing Figures

OBSTETRIC CHAIR

The invention relates to obstetric chairs.

In one class of obstetric chair, the back of the chair is substantially vertical to the seat portion and a portion may be opened for better access to the perineum.

In a prior art type of this class of obstetric chair a backrest is provided by a wedge on a table or by a support bed or in some cases by a chair-like structure with an adjustable back.

These prior apparatuses have the disadvantages of not providing easy access to the perineum nor of retaining the thighs spread apart in position.

In another prior art apparatus, such as that disclosed in U.S. Pat. No. 3,845,945 to Lawley, a tiltable chair is provided. The elevation of the chair is fixed and it tilts about a horizontal pivot point. When it is in the upright section, the perineum is blocked by a moveable seat section which is removable when the chair is tilted.

This type of prior art structure has the disadvantages of not being changeable in elevation and not providing access to the perineum when in a full upright sitting position because the rotating mechanism elevates the legs of the chair to an angle that obstructs access at the only position in which the movable seat section is removed.

In still another prior art apparatus disclosed in the patent to Herzog, U.S. Pat. No. 3,318,596, equipment is provided for spreading of the legs but there is nothing to restrain the legs on the equipment. Moreover, a vertical raisable back support is connected to a leg elevation support so that the legs are fully raised when the back is raised thus causing obstruction to some extent of the access to the perineum.

Accordingly, it is an object of the invention to provide a novel obstetric chair.

It is a further object of the invention to provide an obstetric chair having a unitary back, seat and contoured thigh supports.

It is a still further object of the invention to provide an obstetric chair having a fixed upright sitting posture and a recessed seat portion.

It is a still further object of the invention to provide an obstetric chair having an upright back and a seat portion that is partly cut-away to support only the buttocks and thus provide access to the perineum.

It is a still further object of the invention to provide an obstetric chair with a cut-away seat portion and thigh supports for positioning the thighs at an angle with the remainder of the legs depending downwardly and being supported by foot stirrups.

It is a still further object of the invention to provide a novel obstetric chair with the seat formed to support the buttocks so as to provide an unobstructed entrance into the perineum.

It is still further object of the invention to provide an obstetric chair which may be changed in inclination to the horizontal or in elevation with ease.

In accordance with the above and further objects of the invention, an obstetric chair is mounted for adjustment of the attitude or angle of inclination of the chair with the horizontal under the control of the obstetrician or those aiding him. The chair has an upright back curved to provide side retaining portions to confine the patient.

To confine the patient while permitting access to the perineum, the seat portion is recessed and supports the buttocks, being cut away at its center portion. The thighs of the patient are supported by channel-shaped thigh supports which permit the lower legs (crus) to depend downwardly with the feet fitting in supports, the thigh channels being slightly higher than the seat portion to tend to restrain the patient within the obstetric chair. The thigh supports are at an angle to each other of approximately 80° normally, but in the preferred embodiment, may be adjusted.

To adjust the thigh supports, a crank extends from the chair and turns two worms which rotate shafts supported on the chair and, in turn, adjust the position of the supporting braces beneath the thigh supports.

From the above description, it can be seen that the obstetric chair of this invention has the advantages of: (1) permitting changes in elevation; (2) permitting changes in the attitude of the chair; (3) having a cut-away seat portion to permit access to the perineum; (4) having channel-shaped thigh supports which spread the thighs at selected angles; (5) having a seat portion recessed below the thigh portions to retain the patient; and (6) having a curved upright back portion which tends to restrain the patient.

The above-noted and other features of the invention will be better understood from the following detailed description when considered with reference to the accompanying drawings in which.

Figure 1:
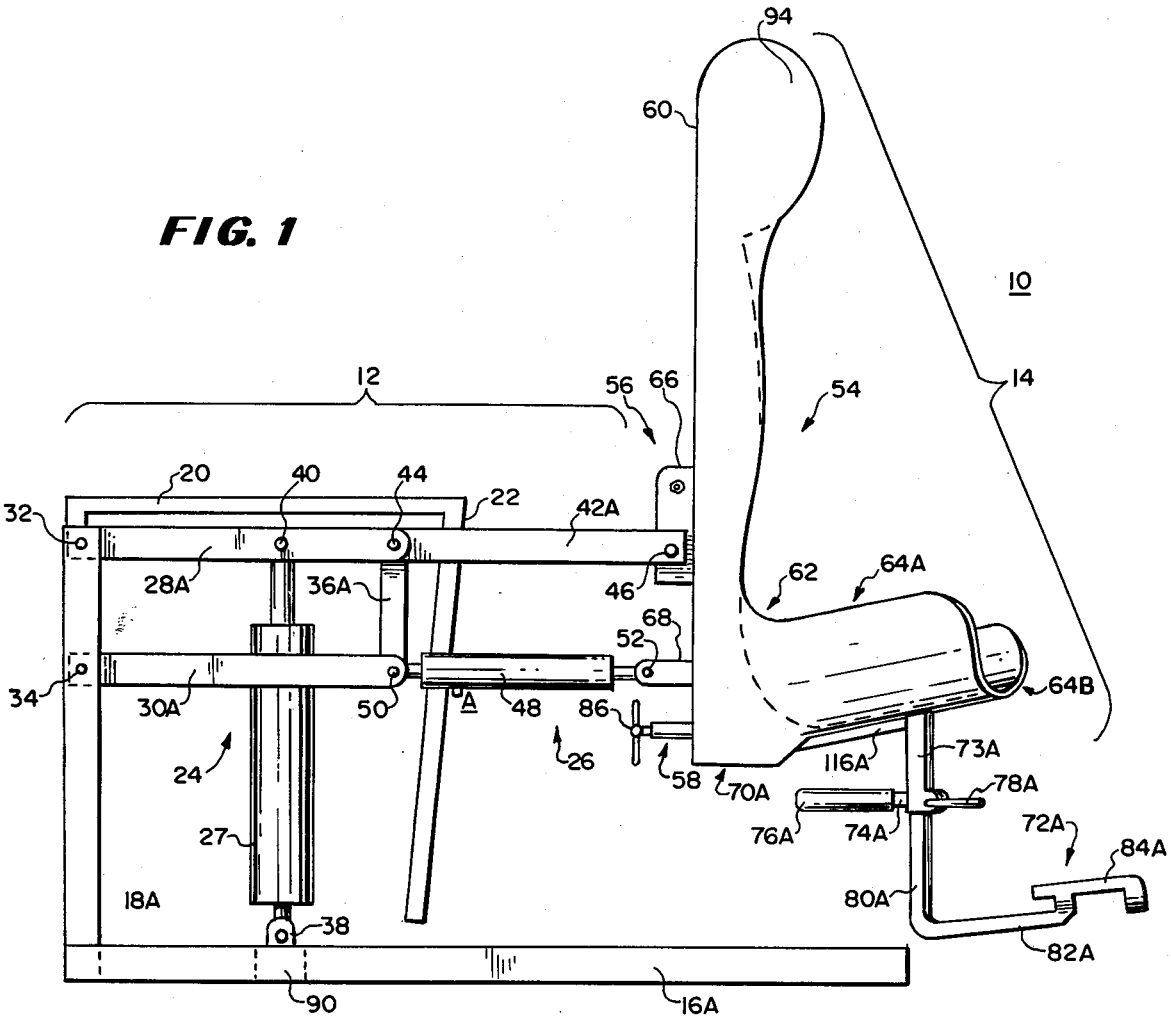
FIG. 1 is a side elevational view of an obstetric chair in accordance with an embodiment of the invention.

In FIG. 1 there is shown an obstetric chair 10 having a chair base or adjustable chair support 12 and a patient rest or chair section 14. The chair section 14 is adjustably mounted to the chair base 12, with the chair base 12 being capable of moving the chair to different elevations and different attitudes or angles of inclination with respect to the horizontal under the control of an operator to position the patient for delivery of a child.

The chair base 12 may be of any suitable design. In the preferred embodiment is the base of a dental chair which may be commercially purchased such as Model PL 200 precision lift base manufactured by Dentalez Mfg. Company in Bay Minnette, Ala. An alternate embodiment, which has been used, will be described in this application for simplicity to illustrate the principle of operation with the understanding that, while the one described is suitable, any other type may be used as suits the convenience of the manufacturer.

In the embodiment of FIG. 1, the chair base 12 includes a horizontal base frame and a vertical base frame, one side of the horizontal base frame being shown at 16A and one side of the vertical frame being shown at 18A. The vertical frame is mounted at its bottom end to the one end of the horizontal frame. The largest portion of the chair base 12 is enclosed in a sheet metal housing represented illustratively at 20 which housing has an aperture at 22 through which a portion of the base extends for mounting to the chair section 14.

Within the housing and supported by the frame, is an elevation adjustment mechanism 24 and an attitude or angle of inclination adjustment mechanism 26. The elevation adjustment mechanism 24 is pivotally connected at one end to the vertical frame, two members of it being shown pivotally mounted to the right-hand post 18A of the vertical frame at one end. Its other end is mounted to one end of the attitude adjustment mechanism 26. The other end of the attitude adjustment mechanism 26 extends through the aperture 22 of the housing 20 and mounts to the chair section 14 to adjust it in position as will be described hereinbelow.

To adjust the elevation of the chair section 14, the elevation adjustment mechanism 24 includes a first pivotally-mounted substantially-horizontal support member and a substantially vertical hydraulic cylinder, the hydraulic cylinder being shown at 27 and two of the members of the horizontal support member being shown at 28A and 30A respectively. The member 28A is pivotally mounted to the vertical frame member 18A at 32 and the member 30A is pivotally mounted to the vertical frame member 18A at 34.

To hold the members 28A and 30A parallel to each other as they pivot about the shoulder bolts 32 and 34, a substantially vertical, pivotally-mounted member 36A is mounted at one end to the end of the member 28A and at its other end to 30A to form a parallelogram-type linkage. The hydraulic cylinder 27 is pivotally mounted at its bottom end to the base frame through a hinge-butt 38 and at its upper end to a pivot pin 40 which passes through the member 28A so that extension of the actuator of the hydraulic cylinder 27 pivots the members 28A and 30A upwardly about the shoulder bolts 32 and 34 and retraction pivots them downwardly.

To control the attitude of the chair 14, the attitude adjusting member 26 includes a substantially horizontal frame having a right-hand frame member 42A pivotally mounted to the outer end of the members 28A and 36A of the height adjusting member at a pivot point 44 within the housing 20 and its other end outside the housing 20 pivotally attached at 46A to the chair section 14. A substantially horizontal hydraulic cylinder 48 is pivotally mounted to the attitude adjustment mechanism, at 50 and pivotally mounted to the chair at 52 so that extension of the actuator arm of the hydraulic cylinder 48 tilts the chair in one direction and retraction in the other direction.

To support the patient in the position selected by the doctor, the chair section 14 includes a contoured patient receiving station 54, a chair frame section 56 and a leg position adjusting section 58. The chair frame section is mounted to the attitude adjustment mechanism 26 and supports the patient receiving section 54 at the selected elevation and attitude. The leg position adjustment mechanism 58 provides a mechanism by which an operator may adjust the angle of the legs of the patient.

To receive the patient, the patient receiving section 54 includes a rigid backrest 60, a seat portion 62 integrally formed with the backrest 60 and two side support sections 64A and 64B. The patient receiving section 54 is shaped to provide a comfortable position of the patient which allows an unobstructed entrance to the perineum and to confine the patient so that she is held in the chair in an upright sitting position. It may be made of any suitable rigid material such as metal or plastic and covered with plastic or cloth to form a comfortable touch. The outer covering may be replaceable, if desired.

To maintain the patient immobilized in the chair in the proper position, the seat portion 62 is recessed to receive the buttocks at a lower elevation than the thighs and thus hold the patient in place. The backrest 60 is at an angle to the seat portion 62 to hold the patient in a sitting position of substantially 90° and has a recessed center portion so that the sides tend to confine the patient. The side support 64A and 64B have upwardly turned outer edges to restrain the thighs from movement.

To permit an unobstructed entrance to the perineum, the seat 54 includes a central opening to be described in greater detail hereinafter and the thigh supports are at an angle to each other which in the preferred embodiment is adjustable by the adjusting mechanism 58. However, a suitable chair can be made with the thigh supports fixed in position with respect to each other at an angle of approximately 80°. The preferred angles are between 75° and 90°.

The chair frame section 56 includes an L-shaped mounting bracket 66, a second mounting bracket 68, two leg support sections one of which is shown at 70A and two foot assemblies, one of which is shown at 72A. To adjustably mount the chair 54, the first L-shaped bracket 66 is pivotally connected to the adjustable member at 46 and is welded or mounted by other means to a metallic or stiff plastic back of the backrest 60 and the second bracket 68 is pivotally mounted at 52 to the actuator arm of the hydraulic cylinder 48 and mounted to the stiff backing member of the backrest 60. The leg support sections are firmly mounted to the backrest 60.

One of the two leg support sections and foot support assemblies are shown in FIG. 1 and will be described herein with the understanding that there is an identical part on the opposite side, the parts described here being designated by reference numerals having the suffix "A" and the corresponding part on the opposite side being indicated elsewhere by reference numerals having the suffix "B".

The leg support section 70A of the chair includes a tubular downwardly extending member 73A having a hand grip 74A extending therefrom and covered at one end by a convenient cover 76A for gripping by the patient. A foot assembly 72A slides into the tubular member 73A, being held at the selected length by the clamp 78. To support the patient's foot, it includes an upwardly extending bar 80A and a horizontally extending bar 82A, with the horizontally extending bar 82A including a stirrup 84A. A similar arrangement is attached to the leg 64B (not shown in FIG. 1) numbered in a corresponding manner except for the suffix B instead of the suffix A.

The attitude adjusting mechanism 58 includes a crank 86 which may be turned to adjust the angle of the thigh supports 64A and 64B with respect to each other in a manner that will be described hereinafter.

Figure 2:
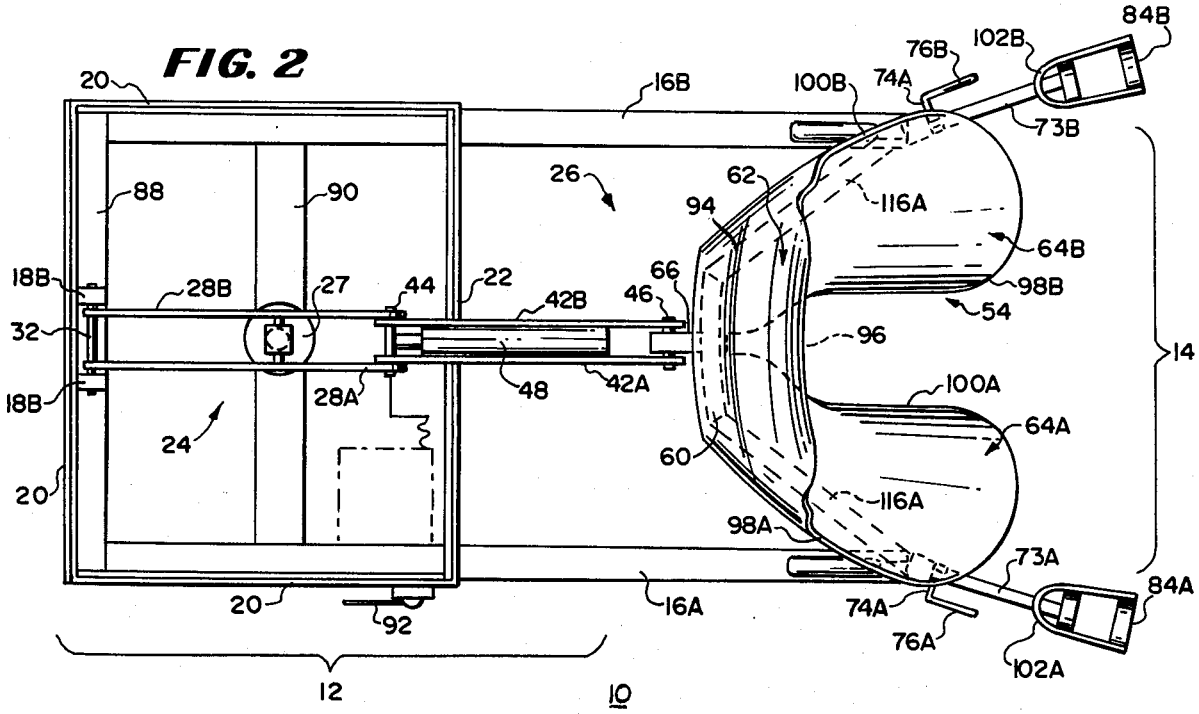
FIG. 2 is a simplified plan view partly broken away of the embodiment of FIG. 1.

As best shown in FIG. 2, the chair base 12, includes two parallel base frame footings 16A and 16B which extend horizontally along the floor underneath the obstetrical chair 10 and two upstanding frame posts 18A and 18B connected at their upper ends by a horizontal support member 88. At the bottom between the horizontal footing braces 16A and 16B is a cross-brace 90 extending between the two orthogonal to them and welded thereto as a further support element. The entire housing is encompassed in the sheet metal 20 having extending outwardly therefrom: (1) the control lever 92; (2) the attitude adjustment mechanism 26; and (3) the ends of the parallel footings 16A and 16B.

Within the housing 20, the elevation adjusting mechanism 24 is pinned between the two parallel posts 18A and 18B for pivotal motion and includes the two parallel arms 28A and 28B pinned to the actuator arm of the actuator 27. Similarly, the parallel arms 42A and 42B are pinned at 44 to the elevation adjustment mechanism 24 and at 46 to the bracket 66 to form the attitude adjustment mechanism 26. The hydraulic cylinder 48 is pinned directly beneath to provide articulation in attitude.

The chair 14 is shown in FIG. 2 with the thigh supports 64A and 64B having their longitudinal axes at 80° with respect to each other which is the general preferred angle during delivery. However, angles of between 75° to 90° are satisfactory.

As best shown in this figure, the backrest 60 extends inwardly near the top such as at 94 and the seat 62 extends downwardly and has an open cut-away portion at 96 extending inwardly to a location near the backrest 60. The thigh supports 64A and 64B are channel-shaped and include upwardly extending walls 98A, 98B, 100A and 100B to form channels which confine the thighs so as to hold them apart. Stirrups 84A and 84B are positioned below and in line with the thigh supports 64A and 64B, extended outwardly by the members 73A and 73B to receive the feet of the patient.

The distance downwardly of the leg supports is controlled by the positions of the telescoping pipes 73A and 80A (FIG. 1). Pipe 80A may be telescoped inwardly to its corresponding receptacle 73A and locked in place by the handle 78A which tightens a bolt against a tapped hole in the column 73A to press against the pipe 80A and hold the stirrup 84A in place. Generally, the foot supports 84A and 84B are aligned below the center line of the thigh supports 64A and 64B but remain clear of the opening 96.

The stirrup assemblies 84A and 84B comprise substantially U-shaped members 102A and 102B having cross pieces and being welded to the lower leg of the stirrups 82A and 82B, with the inner surface of the footrest appearing close to the edge of the thigh supports 64A and 64B.

Figure 3:
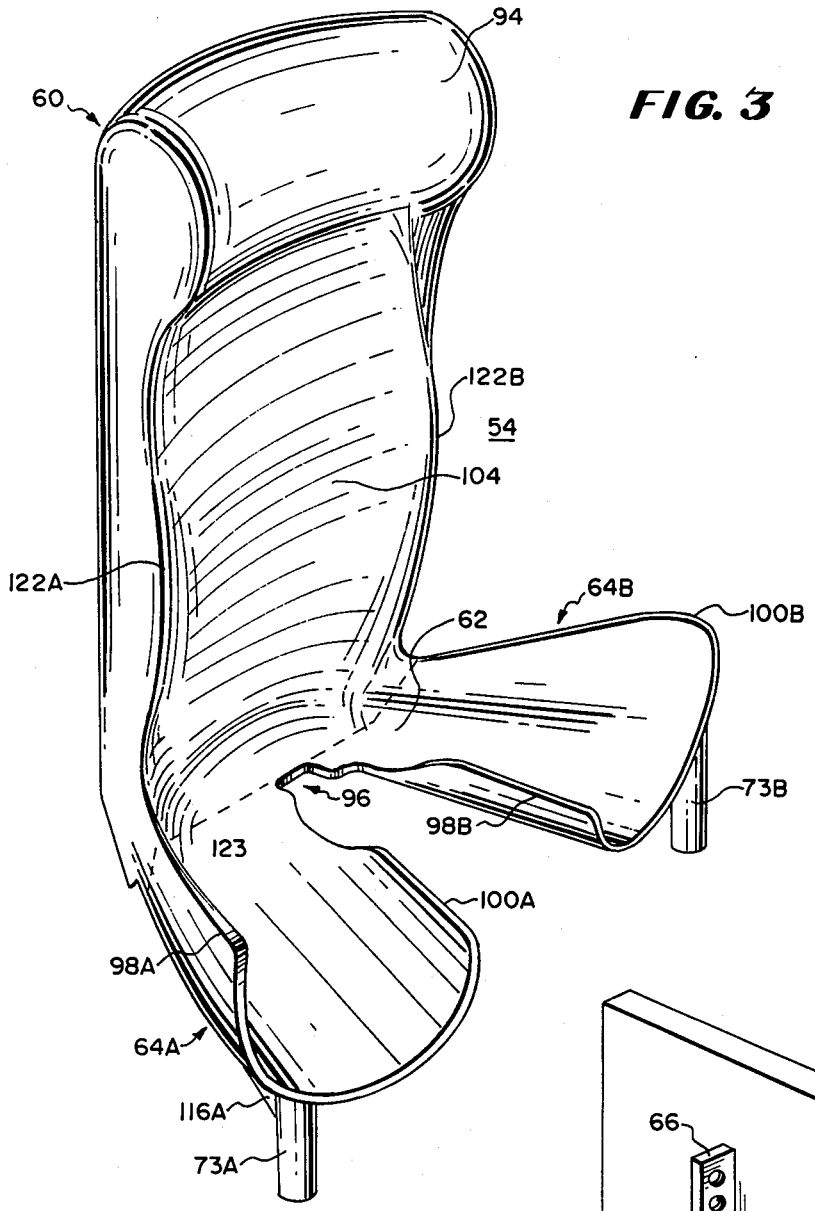
FIG. 3 is a simplified, fragmentary perspective view of a portion of the embodiment of FIG. 1.

In FIG. 3, there is shown a perspective view of the chair 54 which is of a rigid material with a comfortable covering for the patient. The backrest 60 is approximately 40 inches in height and 28 inches in width to provide ample support for the back of a patient. The forwardly extending section at the top is approximately 8 inches in thickness and 12 inches high, with the backrest being recessed to a greater extent at lower and center locations except at a location near its center at 104 in which it is raised slightly 2 or 3 inches, having a thickness at that location of approximately 6 inches with the location above and below having a thickness of approximately 4 inches at their lowest point. The entire back is curved as it proceeds downwardly and the sides extend upwardly approximately 3 inches to form a cradle-like shape which tends to hold the patient in place.

To further hold the patient in place, the seat portion 62 extends downwardly approximately 4 inches lower than the bottom of the thigh supports 64A and 64B. The opening 96 extends close to the back of the backrest 60 at which point the thigh support 64A and 64B begin. The channels which these thigh supports form have a width of approximately 6 inches to receive an ample thigh and a height of 6 inches on each of the side walls 98A, 98B, 100A and 100B at their outer end. They are approximately 14 inches from their outer end to the backside of the backrest 60.

Figure 4:
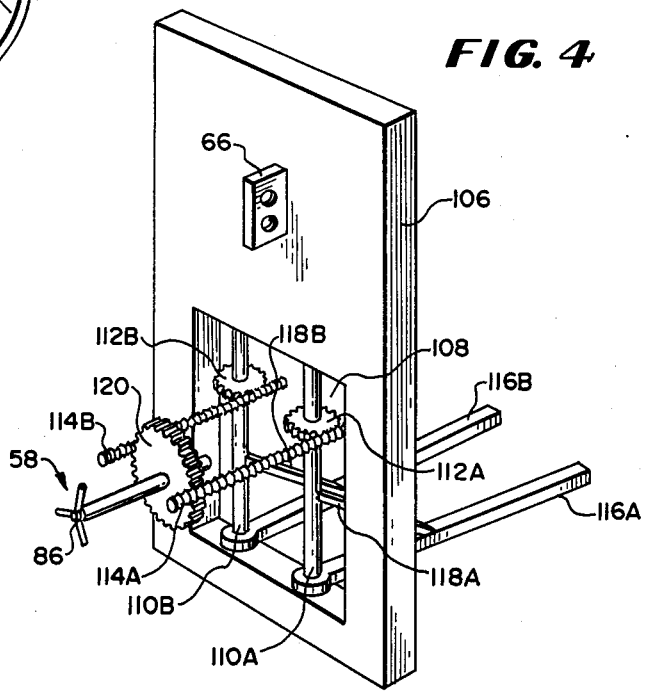
FIG. 4 is a simplified, fragmentary view of another portion of the embodiment of FIG. 1.

In FIG. 4, there is shown a simplified perspective view of the thigh support position adjusting mechanism 58 as it is mounted to the rigid support 106 in the backrest 60 of the chair 14 near the location of the bracket 66 to which the attitude adjusting mechanism 26 (FIGS. 1 and 2) are attached. Within this rigid support is an open portion 108 within the back support 106.

Within the opening 108 are rotatably mounted two axles 110A and 110B supported at their top and the bottom ends within bearings. The axles 110A and 110B each engage a corresponding one of the worm gears 112A and 112B for rotation therewith and each of these worm gears engage corresponding ones of the worms 114A and 114B.

Welded near the bottom of the axles 110A and 110B are corresponding thigh support braces 116A and 116B which are positioned under corresponding ones of the thigh supports 64A and 64B (FIGS. 1, 2 and 3). They are braced on their corresponding axles by cross braces 118A and 118B each of which is welded at one of its ends to a corresponding one of the axles 110A and 110B and at its other end to the bottom side of a corresponding one of the thigh support braces 116A and 116B for pivotable movement therewith.

The adjustment handle 86 (FIG. 1) which extends from the backrest 60 is mounted for rotation with a worm gear 120 which engages on one of its sides the worm 114A and on its other side the worm 114B to rotate the worms in opposite directions as the crank 86 is turned. The worms 114A and 114B engage corresponding ones of the worm gears 112A and 112B on the same side of those gears so as to turn the vertical axles 110A and 110B in opposite directions as the crank 86 is turned. As the axles turn in opposite directions, the thigh support braces 116A and 116B adjust the angle of the thigh supports 64A and 64B (FIGS. 1, 2 and 3) with respect to each other.

In operation, the patient is seated in the obstetric chair 10, which receives and holds the patient while the chair is adjusted by the obstetrician for delivery.

To seat the patient in the chair section 54, the chair is generally lowered to a convenient elevation. This is accomplished by actuating one of the controls 92 (FIG. 2) which starts a hydraulic motor and causes the actuator arm of the hydraulic cylinder 27 (FIG. 1) to be extended or retracted depending on the position of the control 92. When the actuator arm is extended, the chair is elevated and when it is retracted the chair is lowered.

The attitude or the angle of inclination of the chair is adjusted by a control lever just below 92 (FIG. 2) not shown in the drawings. This control controls the position of the actuator of the hydraulic cylinder 48 which pivots the chair about the shoulder bolts 44 and 46 after it has been elevated to the proper position by a pivoting about the shoulder bolts 32 and 34 under the control of the hydraulic cylinder 27.

When the chair is at a convenient elevation, the position of the thigh supports 64A and 64B (FIGS. 2 and 3) are adjusted by turning the crank handle 86 (FIGS. 1 and 4). The turning of the crank handle turns the worm gear 120 (FIG. 4) which rotates the worms 114A and 114B in opposite directions. The worms in turn rotate the worm gears 112A and 112B in opposite directions to turn the axles 110A and 110B in opposite directions. The turning of the axles 110A and 110B move the thigh support braces 116A and 116B to adjust the angle of the opening 96 (FIGS. 2 and 3). The seat 54 is separated at 123 except for the outer cloth covering to permit adjustment of the thigh supports 64A and 64B.

Once the patient is seated, she is comfortably retained in place by the shape of the chair section 54. The chair section has a seat portion 62 (FIGS. 1, 2 and 3) which is about 4 inches lower than the bottom of the thigh supports 64A and 64B. Moreover, the backrest 60 extends further in at the bottom than at the mid-section 104 and then extends further in between the mid-section and forward extending section 94 to further confine and position the patient. The sides 122A and 122B are raised so that the backrest curves in a shell shape to further restrain the patient.

With the patient seated within the chair section 54, the obstetrician or other attendants position the patient for the convenience of the obstetrician. To do this, the elevation is again adjusted by means of the lever 92 (FIG. 2) and the attitude by a similar lever. Just as in lowering the chair to seat the patient, the hydraulic cylinder 27 (FIG. 1) raises the chair by extending its actuator arm and lowers it by retracting its actuator arm to pivot the chair about the shoulder bolts 32 and 34. Similarly, the hydraulic cylinder 48 changes the attitude or inclination with the horizontal of the chair by pivoting the chair about the shoulder bolts 44 and 50.

The opening 96 and the angle of the thigh supports 64A and 64B are also adjusted by turning the crank. Generally, the legs are spread apart so that the center line of the thigh supports 64A and 64B form an 80° angle with respect to each other. This is done by turning the crank 86 (FIGS. 1 and 4) which rotates the worm gear 120 to turn the worms 114A and 114B in opposite directions. The turning of the worms 114A and 114B again rotate the gears 112A and 112B the axles 110A and 110B to move the thigh support braces 116A and 116B toward or away from each other to change the angle of the thigh supports 64A and 64B.

The position of the patient can, of course, be adjusted at any time during the use of the chair although the patient remains in the full upright sitting position during the entire process since the chair itself is rigid. After her treatment, the patient can be lowered in the same way that other positions were adjusted so that she may leave the chair.

From the above description, it can be understood that the obstetric chair 10 of this invention has several advantage such as: (1) the attitude and elevation of the patient may be conveniently changed; (2) the angle at which the patient's legs are separated may be adjusted; (3) the chair permits ready accessibility of the perineum of the patient because of the cut-away portion 96; (4) the chair is shaped with channel-shaped thigh supports to confine the legs in position; (5) the seat of the chair is lowered and its back is shaped with confining sections to hold the patient in place comfortably within the chair.

Although a specific embodiment has been described, many modifications and variations of the preferred embodiment may be made without deviating from the invention. Accordingly, it is to be understood, that within the scope of the appended claims, the invention may be practiced other than as specifically described.

What is claimed is:

1. An obstetric chair comprising:

a seat portion;

a backrest portion having a longitudinal axis;

said longitudinal axis of said seat portion being at a substantial angle to said backrest portion whereby a patient is seated upright in said obstetric chair;

said back rest position being cradle-shaped and curved to form side sections, whereby the torso of said patient is retrained from lateral movement;

means for supporting the thighs of the patient;

said means for supporting the thighs being channel shaped, whereby the thighs of said patient are restrained from lateral movement;

said means for supporting the thighs being above said seat portion, whereby said patient is restrained from forward movement in said seat;

said seat portion having a centrally located cut-away portion whereby said patient is supported by the buttocks and thighs on said obstetric chair; and said back rest portion including a central portion extending outwardly over said seat portion, whereby upward movement of said patient is restrained.

2. An obstetric chair in accordance with claim 1 including means for moving said thigh supports to different angular positions with respect to said portion, whereby the patient's legs may be spread at a selected angle.

3. An obstetric chair in accordance with claim 2 further including stirrups having footrests at the end depending from said thigh supporting sections, whereby said patient's crus may be depended downwardly with the feet resting in said footrests.

4. An obstetric chair in accordance with claim 3 in which said means for moving said thigh supports includes a hand crank and a transmission gear means for moving said thigh supports.

5. An obstetric chair according to claim 1 in which the means for supporting the thighs of the patient in positions angularly spaced apart comprise two means for supporting the thighs of the patient positioned at an angle with respect to each other of between 75 and 90 degrees.

6. An obstetric chair according to claim 1 in which the seat portion is recessed to a level approximately 4 inches lower than the thigh-supporting portions; and the central portion of the backrest portion extends approximately 2 inches outwardly so as to force the back of the patient outwardly to a position above the recessed seat portion and the sides extend at least three inches outwardly to restrain the patient from lateral movement.

7. An obstetric chair according to claim 1 in which the seat portion is recessed to a level approximately 4 inches lower than the thigh-supporting portions.

* * * * *

UNITED STATES PATENT AND TRADEMARK OFFICE

CERTIFICATE OF CORRECTION

PATENT NO. : 4,221,370

DATED : September 9, 1980

INVENTOR(S) : Michael Alan Redwine

It is certified that error appears in the above-identified patent and that said Letters Patent are hereby corrected as shown below:

Column 1, line 12, after "prior", insert "art".

Column 8, line 12, change "retrained" to "restrained".

Signed and Sealed this

*Tenth* Day of *February 1981*

[SEAL]

*Attest:*

RENE D. TEGTMEYER

*Attesting Officer*

*Acting Commissioner of Patents and Trademarks*